US005743337A

United States Patent [19]

MacDonald, III

[11] Patent Number: 5,743,337

[45] Date of Patent: *Apr. 28, 1998

[54] RELOCATABLE SPRINKLER ASSEMBLAGE

[75] Inventor: Norman J. MacDonald, III, Lunenburg, Mass.

[73] Assignee: PNM, Inc., Boxboro, Mass.

[ * ] Notice: The term of this patent shall not extend beyond the expiration date of Pat. No. 5,570,745.

[21] Appl. No.: 743,498

[22] Filed: Nov. 4, 1996

Related U.S. Application Data

[63] Continuation-in-part of Ser. No. 455,026, May 31, 1995, Pat. No. 5,570,745.

[51] Int. Cl.[6] ..... A62C 37/50

[52] U.S. Cl. ..... 169/16; 169/37; 169/51; 239/288.5

[58] Field of Search ..... 169/51, 5, 16, 169/17, 18, 37, 38, 39, 40, 41, 90, 91; 239/288, 288.3, 288.5; 137/377, 382, 559

[56] References Cited

U.S. PATENT DOCUMENTS

| | | | |
|---|---|---|---|
| 2,017,841 | 10/1935 | Coleman | 137/561 R |
| 2,890,758 | 6/1959 | Pfalzgraff et al. | 169/37 |
| 3,388,747 | 6/1968 | Hodnett | 169/39 |
| 3,727,695 | 4/1973 | Danton | 169/37 |
| 4,706,759 | 11/1987 | Grasseschi | 169/51 |
| 4,964,470 | 10/1990 | Gaulin | 169/56 |
| 5,327,976 | 7/1994 | Hattori | 169/43 |
| 5,396,959 | 3/1995 | MacDonald | 169/51 |
| 5,570,745 | 11/1996 | MacDonald, III | 169/16 |

FOREIGN PATENT DOCUMENTS

| | | | |
|---|---|---|---|
| 5-329222 | 12/1993 | Japan | 169/16 |

*Primary Examiner*—Andrew C. Pike
*Attorney, Agent, or Firm*—Morse, Altman & Benson

[57] ABSTRACT

A relocatable sprinkler assemblage includes a flexible conduit connecting to a source of fire-suppression fluid, a heat-sensitive sprinkler head, a rigid fitting connecting the conduit to the sprinkler head, and a removable cap that, together with the fitting, creates a watertight compartment around the sprinkler head so that the assemblage can be moved while the sprinkler system remains pressurized and operational. The cap includes alerts the user to the condition of the sprinkler head, whether or not the head has been activated during the relocation process. In one embodiment, the cap is transparent, so that the condition can be determined by looking for fluid inside the cap. In another embodiment, the cap has a valve that can be operated manually to determine if there is fluid in the cap. In a third embodiment, the cap has a flexible bag that appears rigid if there is pressurized fluid in it.

18 Claims, 13 Drawing Sheets

RELOCATABLE SPRINKLER ASSEMBLAGE

RELATED APPLICATIONS

The present application is a continuation-in-part application of application Ser. No. 08/455,026, dated May 31, 1995 for RELOCATABLE SPRINKLER ASSEMBLAGE, now U.S. Pat. No. 5,570,745 in the name of Norman J. MacDonald III.

BACKGROUND OF THE INVENTION

1. Field of the Invention

The present invention relates generally to sprinkler systems and, more particularly, to the protection of sprinkler heads during relocation.

2. The Prior Art

Sprinkler systems are in wide use today in office buildings, factories, and some homes. One such sprinkler system is disclosed in U.S. Pat. No. 5,396,959, entitled Sprinkler System and issued to Norman MacDonald. The sprinkler system includes a sprinkler head, a water supply, a flexible conduit connecting the water supply to the sprinkler head, and a means for mounting the sprinkler head. The sprinkler head extends into the chamber being protected through holes in tiles that are supported by a lattice suspended from the ceiling.

A different type of mounting arrangement exists for installation in a clean room. The sprinkler heads cannot extend through tiles because the tiles are replaced by heavy filter assemblies. Thus, the sprinkler heads extend through holes in the lattice members themselves.

Regardless of the type of sprinkler system or the environment in which is it used, the head has a temperature-sensitive valve that regulates the flow of water. When the temperature in the vicinity of the valve rises above a predetermined level, the valve opens, allowing the water to run through the valve. Typically, the head is configured so that the water is sprayed over a large area when the valve opens.

In some instances, a sprinkler head must be relocated. Because the valve is sensitive to temperature, it tends to be very fragile and sensitive to physical movement and to impacts as well. Thus, under normal circumstances, relocation requires that the sprinkler system be shut down and completely drained beforehand in order to avoid an accident with an operational sprinkler head that can cause injury to people and damage to equipment. In some instances, however, it is necessary to relocate the sprinkler heads while the system is under pressure and fully operational. This is especially true in clean rooms and hazardous environments where regulations and insurance requirements dictate that the sprinkler system must always remain fully operational. Thus, some type of protection device is needed to protect the head from activating while being relocated.

There are several different protective caps in existence for sprinkler heads. Two such caps are disclosed in U.S. Pat. No. 2,890,758, issued to R. M. Pfalzgraff et al., and U.S. Pat. No. 3,388,747, issued to R. M. Hodnett. These caps are designed to protect the temperature-sensitive sprinkler head from chemical corrosion and mechanical stress, respectively, during normal operation; thus they permanently cover the sprinkler head. They are not designed to act as temporary protection while the sprinkler head is being relocated. When the sprinkler head is not subjected to chemical corrosion or mechanical stress in the operating environment, temporary protection is desired because it does not affect the normal operation of the head. Permanent covers can affect the operation of the head by decreasing its sensitivity to temperature changes. With a temporary cover, protection is only provided when the head is being relocated, and, therefore, does not affect its sensitivity.

Thus, there continues to be a need for a device that physically protects a pressurized and operational sprinkler head temporarily while the head is being relocated.

SUMMARY OF THE INVENTION

An object of the present invention is to provide a sprinkler assemblage that can be safely relocated while the rest of the sprinkler system remains pressurized and operational.

Another object is to provide a sprinkler assemblage that can be safely relocated while pressurized.

A further object is to provide a sprinkler assemblage that can be safely relocated while not effecting the temperature sensitivity of the sprinkler head when not being relocated.

The relocatable sprinkler assemblage of the present invention operates as part of a sprinkler system. One form of sprinkler system includes a rigid, stationary fire-suppression fluid supply grid having interconnected pipes supported above a suspended ceiling and flexible sprinkler arms connected to the grid and extending through the ceiling tiles. Another form of sprinkler system, used in a clean room, is the same as the previous system except that, because large filter assemblies replace the ceiling tiles, the arms extend through the lattice members that support the filters. The relocatable sprinkler assemblage of the present invention in effect replaces the flexible sprinkler arm of the prior art.

The relocatable sprinkler assemblage of the present invention includes a flexible conduit, a sprinkler head, a fitting, and a cap. The conduit is preferably composed of an annealed stainless steel braid, one end of which connects to the system grid and the other end of which connects to the fitting.

The sprinkler head is a typical prior art, temperature-sensitive sprinkler head designed to be used in sprinkler systems. It has a length of cylindrical pipe that is obstructed by a central plug and pair of flexible links that are designed to melt at about 165° F. When the links melt, the plug is dislodged from the pipe by the force of the system fluid acting against it and the fluid is dispersed over a large area by a dispersion device. The pipe is threaded for connection to the fitting.

The fitting is a cylindrical tube, preferably composed of steel or stainless steel, that has an outside diameter at least that of the overall diameter of the sprinkler head. The outer surface adjacent to the sprinkler head is threaded to accept a cap. The inner surface of the fitting adjacent to the sprinkler head is threaded to accept the external thread of the sprinkler head.

There are a number of variations to the fitting, all possible combinations of which are contemplated by the present invention. There are two configurations of the inner surface. In the first, the inner surface is substantially cylindrical. In the second, the inner surface has three sections, the above-described section threaded for the sprinkler head, a larger cylindrical section at the conduit end of the fitting, and a conical section that connects them.

There are three preferred methods for attaching the fitting to the conduit. In the first, the outer surface adjacent to the conduit end is adapted to receive one end of the conduit, where the conduit is permanently bonded to the fitting, for example, by welding. In the second method, the section of the inner surface adjacent to the conduit end is threaded to accept an external thread at the end of the conduit. In the third method, the section of the outer surface adjacent to the conduit end is threaded to accept an internal thread at the end of the conduit.

There are three preferred methods for mounting the fitting to the ceiling. In the first, the fitting is mounted in the central hub of a frame and the frame is held in place by the wires that suspend the ceiling tile. In the second, the outer surface has a threaded intermediate section and shoulder between the conduit end and the intermediate section. The fitting is inserted through a hole in the ceiling and a mounting nut is turned onto the intermediate section until the ceiling is securely clamped between the nut and the shoulder. In the third method, a plurality of arms extend from the outer surface. A screw near the end of each arm turns into a threaded hole in the ceiling frame.

The final component of the present invention is the cap. The function of the cap is to create a watertight compartment around the sprinkler head in order to contain any fluid that may come from the sprinkler head and to alert the user when fluid is being contained by the cap. There are three preferred embodiments. In all the embodiments, the cap is preferably threaded onto the threads on the outer surface of the fitting adjacent to the sprinkler head. Preferably, an O-ring in the cap creates a watertight seal between the cap and the fitting.

In the first embodiment, the cap is a rigid, transparent cup. The user looks into the cup to determine whether or not fluid is being contained by the cup. In the second embodiment, the cap is a rigid cup with a valve extending from the bottom. The user opens the valve to determine if there is any fluid being contained by the cup. In the third embodiment the cap includes a rigid collar and a flexible bag. When the cap is not containing fluid, the bag is flaccid. When the cap is containing fluid, the bag is relatively rigid.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION

Figure 1:
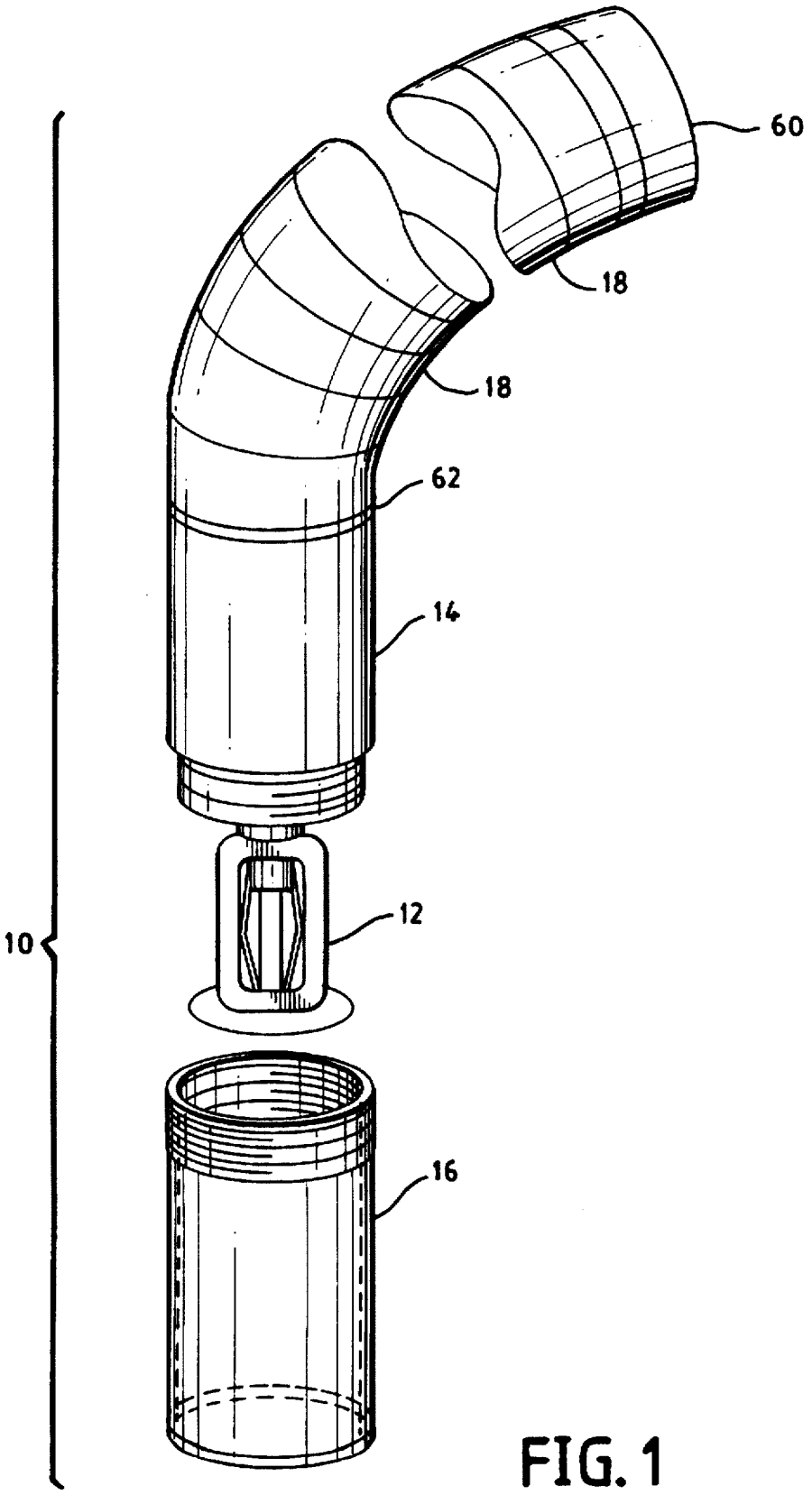
FIG. 1 is a perspective view of the present invention.
Figure 2:
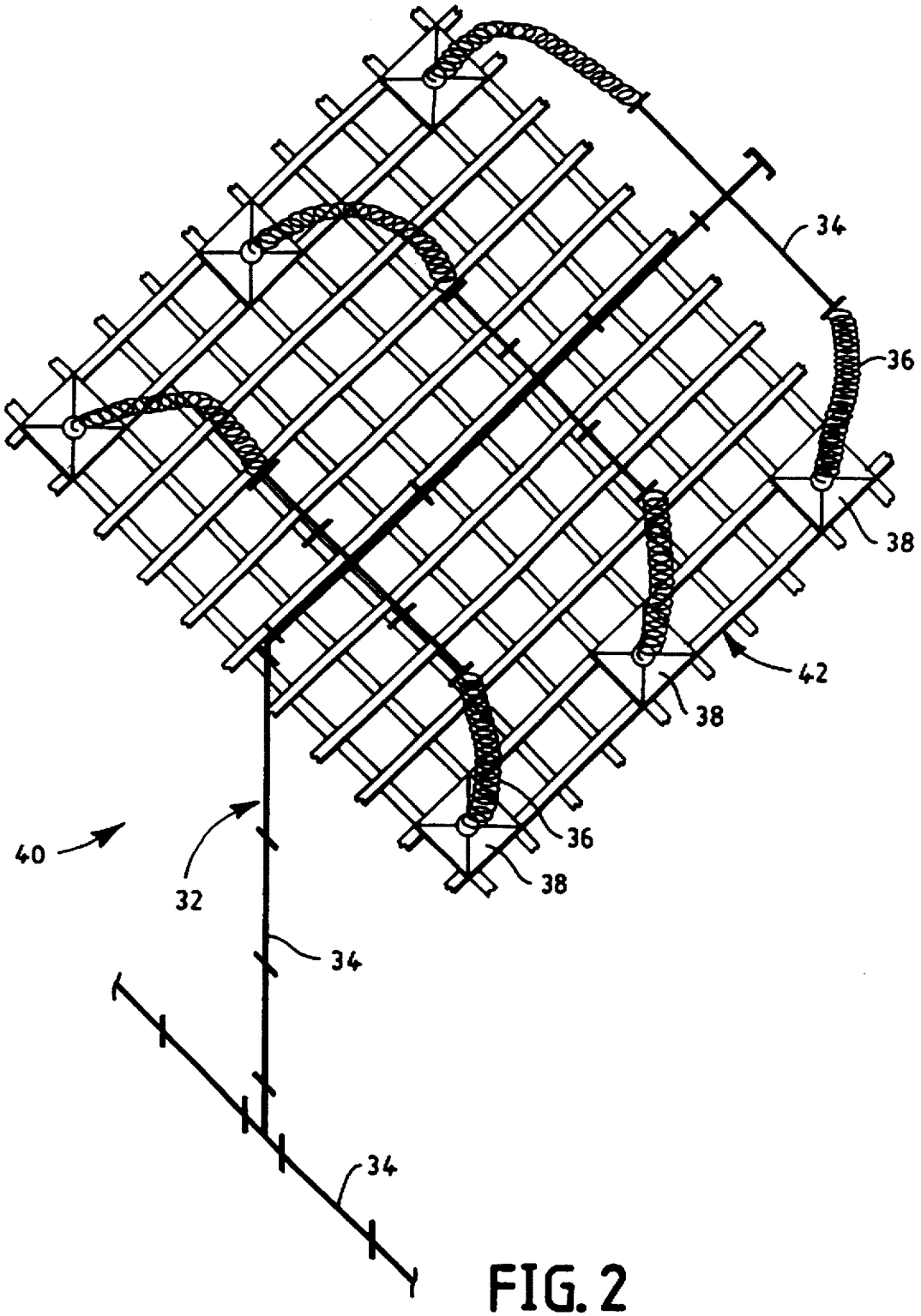
FIG. 2 is a top perspective view of a sprinkler system.
Figure 3:
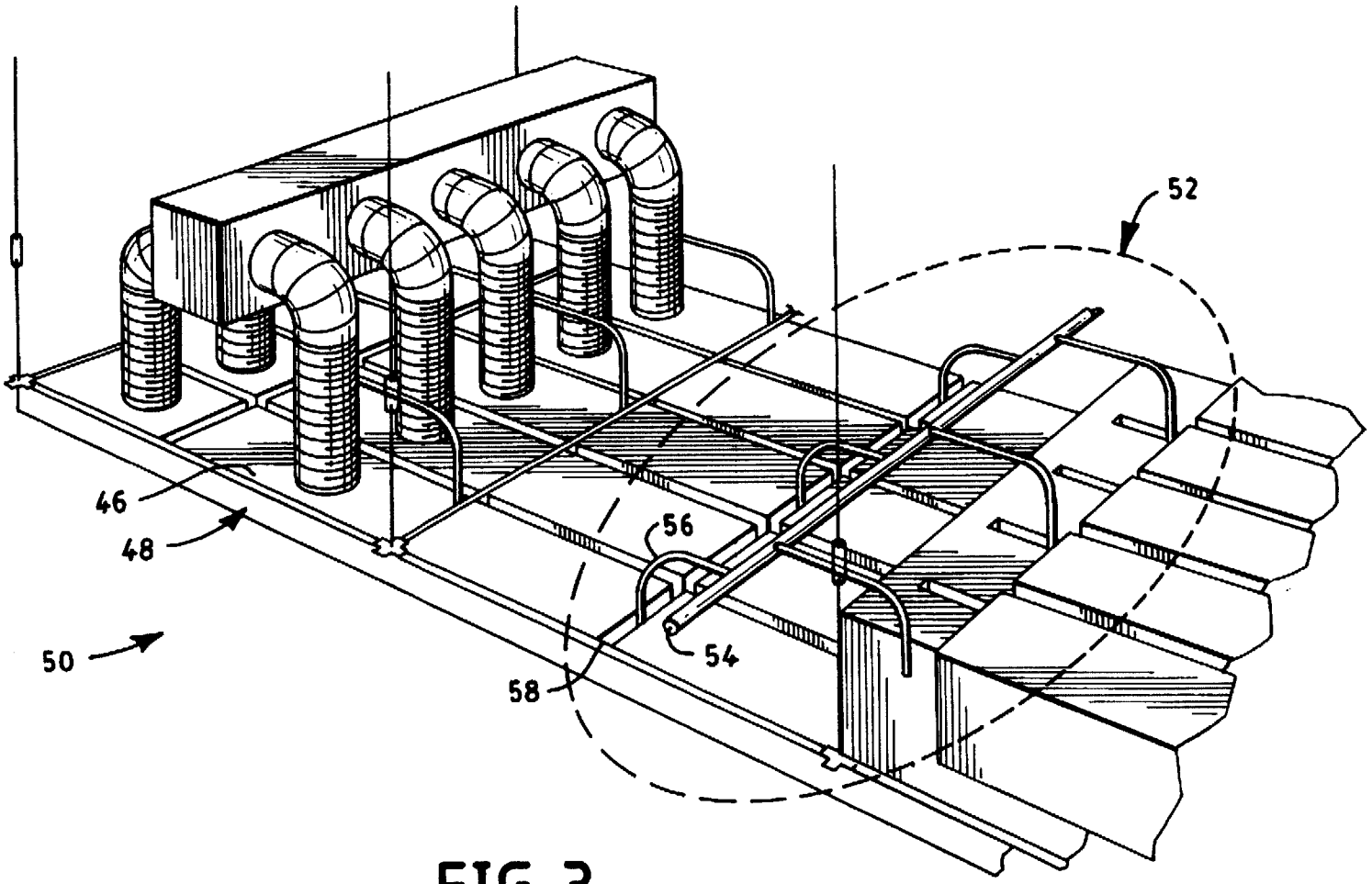
FIG. 3 is a top perspective cut-away view of a sprinkler system for a clean room.

The Sprinkler Assemblage of FIGS. 1 to 3

FIG. 1 shows a perspective view of the relocatable sprinkler assemblage of the present invention 10. The relocatable sprinkler assemblage operates as part of a sprinkler system, an example of which is shown in FIG. 2. The sprinkler system 40 operates in cooperation with a suspended ceiling 42. The sprinkler system 40 includes a rigid, stationary fire-suppression fluid supply grid 32 comprising a plurality of interconnected pipes 34 rigidly supported above the suspended ceiling 42, and a plurality of flexible sprinkler arms 36 connected to the fluid supply grid 32 and extending through the suspended ceiling tiles 38.

FIG. 3 shows a cut-away view of a sprinkler system for a clean room 50. It is similar to the previously described system 40 in that it also includes a rigid, stationary fire-suppression fluid supply grid 52 comprising a plurality of interconnected pipes 54 rigidly supported above the suspended ceiling 48 and a plurality of flexible sprinkler arms 56 connected to the fluid supply grid 52. Because a sprinkler system 50 for a clean room has large filter assembles 46 in place of the tiles through which the arms 56 cannot extend, the arms 56 extend through the lattice members 58 that support the filters 46. The relocatable sprinkler assemblage of the present invention 10 in effect replaces the flexible sprinkler arm of the typical sprinkler system of the prior art.

The relocatable sprinkler assemblage of the present invention 10 includes a sprinkler head 12, a fitting 14, a cap 16, and a flexible conduit 18.

Preferably, the flexible conduit 18 is composed of an annealed stainless steel braid. One end 60 of the conduit connects to a source of fluid, for example, a rigidly supported, stationary grid of water pipes. The other end 62 of the conduit connects to the fitting 14 as described below.

Figure 4:
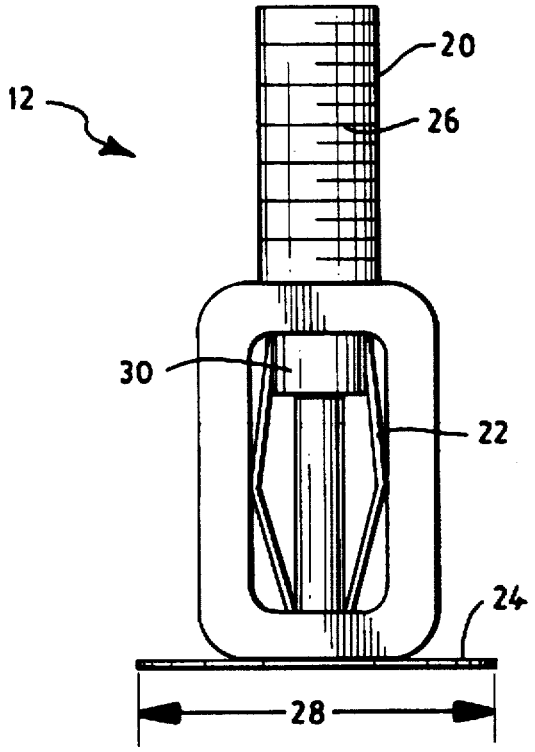
FIG. 4 is a side view of the sprinkler head.

The Sprinkler Head of FIG. 4

The sprinkler head 12, as shown in FIG. 4, is a typical prior art, temperature-sensitive sprinkler head designed to be used in sprinkler systems. The sprinkler head 12 is provided with a length of cylindrical pipe 20 that is obstructed by a central plug 30, and pair of flexible links 22 that are designed to melt at about 165° F. When, due to heat and/or fire, the links 22 do melt, the plug 30 is dislodged from the pipe 20 by the force of the sprinkler system fluid acting against it. The fluid is dispersed over a large area by a dispersion device 24. The outer surface of the pipe 20 is threaded for connection to the fitting 14 as described below. The overall diameter 28 of the sprinkler head 12 can vary depending on the particular sprinkler head 12 chosen.

The Fitting of FIGS. 5–10

Figure 5:
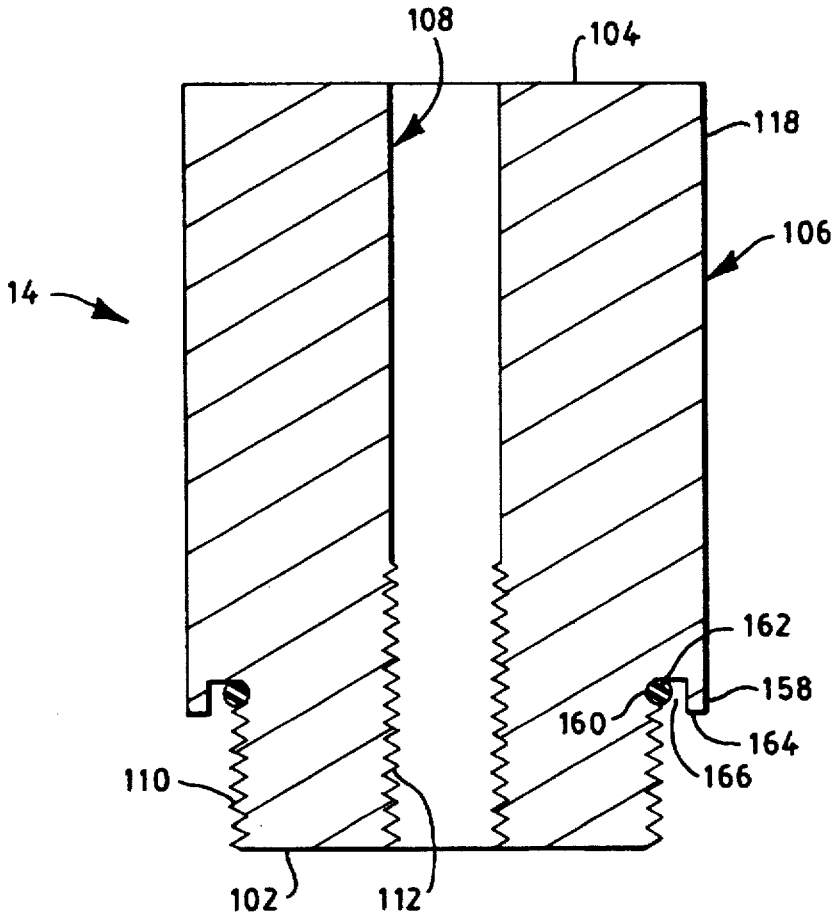
FIG. 5 is a cross-sectional view of a basic configuration of the fitting.

The basic fitting 14 is shown in FIG. 5. However, the fitting 14 has a number of variations in several parameters, any possible combination of which is contemplated by this invention. FIG. 5 shows those items that are common to all combinations of the fitting 14. All combinations of the fitting 14 are rigid and are preferably composed of steel or stainless steel.

The basic fitting 14 is a substantially cylindrical tube that has an outside diameter at least that of the overall diameter 28 of the sprinkler head 12. The cap section 110 (210, FIG. 6) of the outer surface 106 (206, FIG. 6) adjacent to the sprinkler head end 102 (202, FIG. 6) has a smaller diameter than the remainder of the outer surface 106 (202, FIG. 6). Extending into the shoulder 164 created by the diameter difference is a circular groove 166. The axis of the groove 166 is coincident with the longitudinal axis of the fitting 14 and the outer surface of the groove 166 is defined by a downwardly extending rim 158.

The cap section 110 is threaded to accept a cap 16. Within the circular groove 166 and at the upper end of the cap section 110 is an annular groove 160 in which is located a resilient O-ring 162. The purpose and use of these components is described below with reference to the cap 16.

The inner surface 108 of the fitting has an axis coincident with the longitudinal axis of the fitting 14. A section 112 of the inner surface 108 adjacent to the head end 102 is substantially cylindrical and threaded, where the thread is sized to accept the external thread 26 from the sprinkler head 12.

The first variable parameter of the fitting 14 is the structure of the inner surface, of which there are two contemplated configurations. In one configuration, shown in FIG. 5, the inner surface 108 is substantially cylindrical with a diameter that is about the same as the head inner section 112. In the second configuration, shown in FIG. 6, the inner surface 208 is divided into three sections. The head inner section 212 is the same as the head inner section 112 of the basic embodiment of FIG. 5. The inner conduit section 214 at the conduit end 204 is substantially cylindrical with its axis coincident with the longitudinal axis of the fitting 14, has a diameter larger than that of the head inner section 212, and extends a significant distance into the fitting 14. Connecting the two inner sections 212, 214 is a conical section 216.

Figure 6:
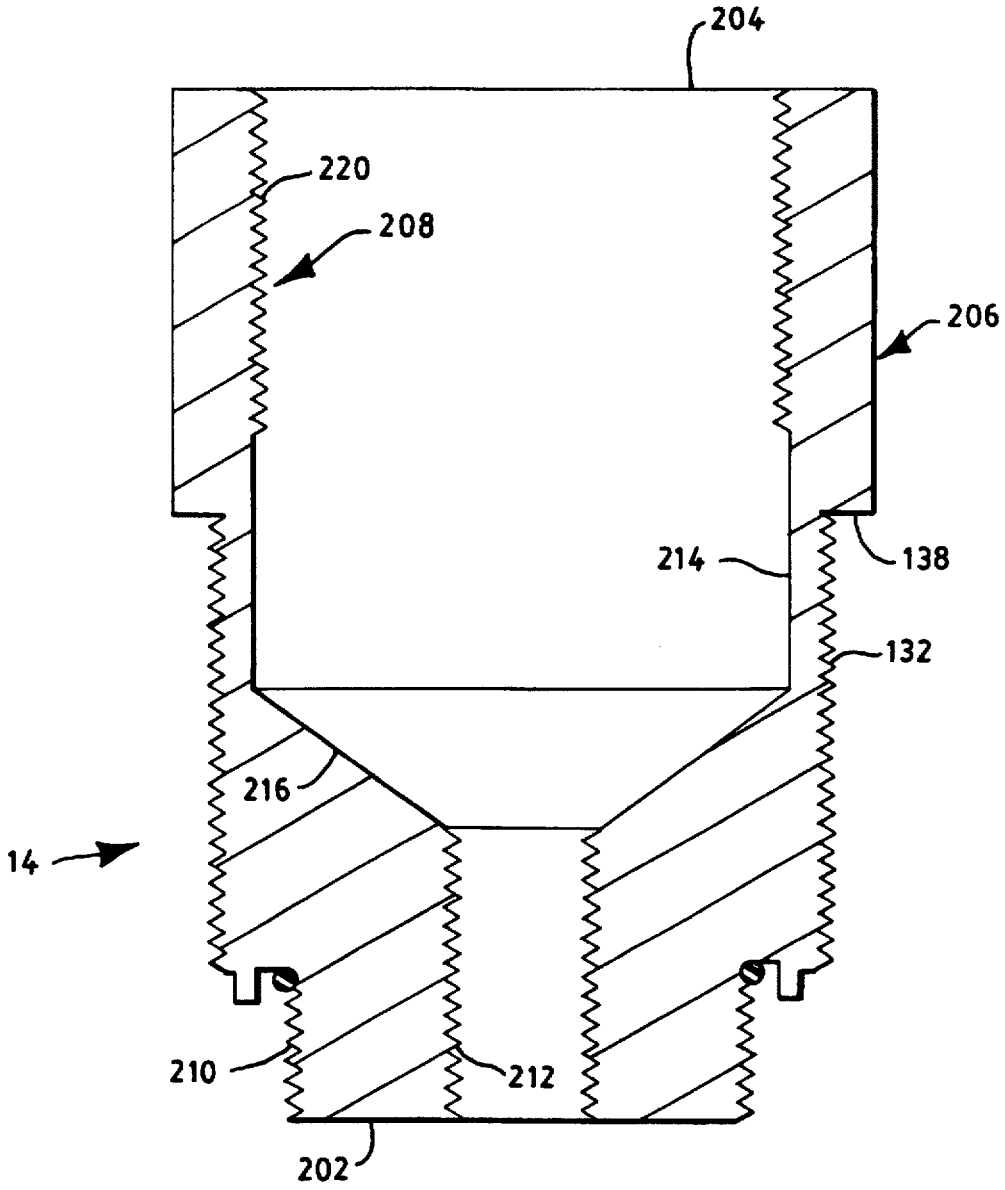
FIG. 6 is a cross-sectional view of another configuration of the fitting.
Figure 7:
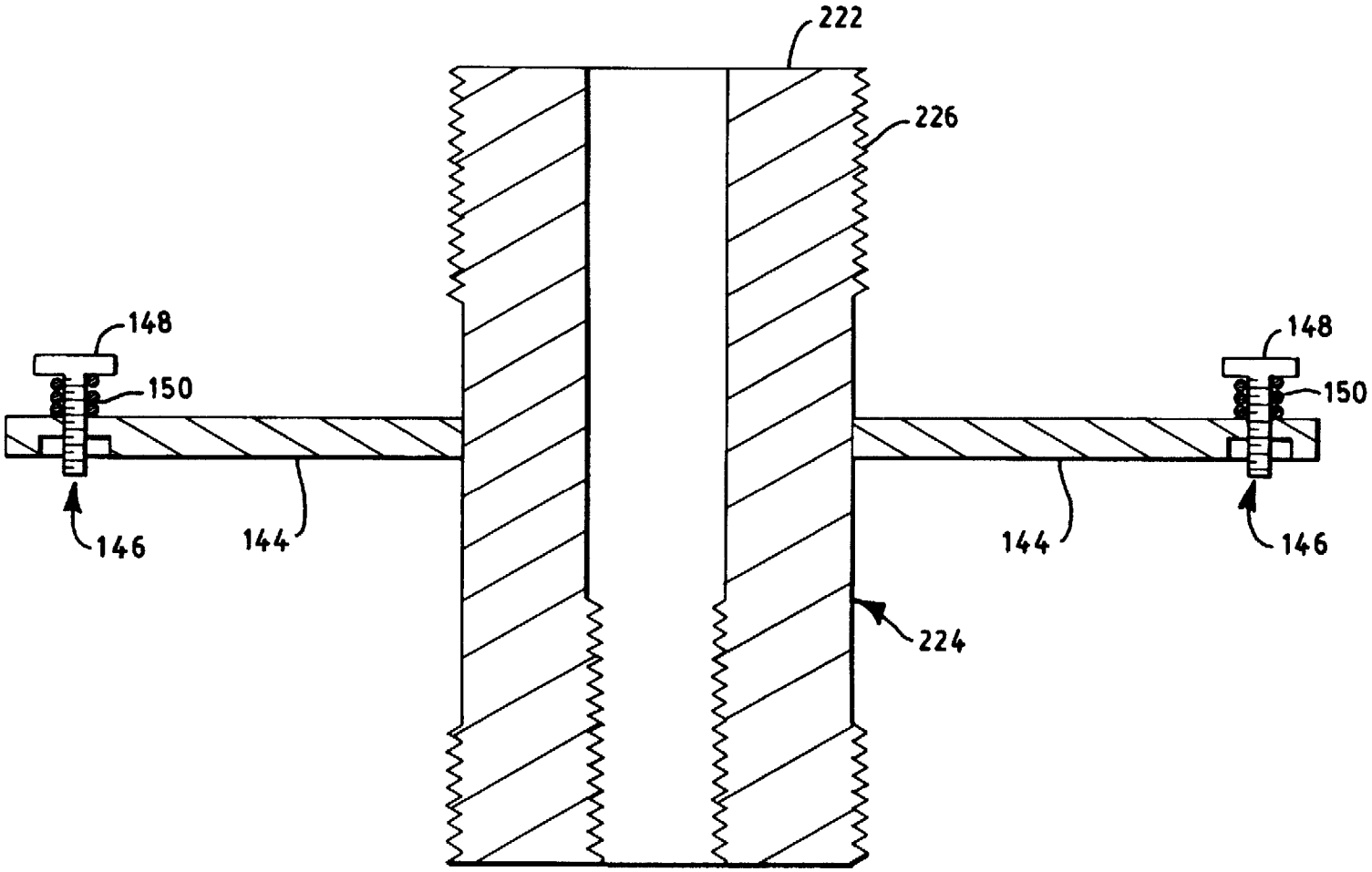
FIG. 7 is a cross-sectional view of a third configuration of the fitting.

The second variable parameter of the fitting 14 is the method by which the fitting 14 is attached to the conduit 18, of which there are three contemplated methods. The first method is shown in the basic embodiment of FIG. 5. The section 118 of the outer surface 106 adjacent to the conduit end 104 is adapted to receive one end of the conduit 62, where the conduit 62 is bonded to the fitting 14 by any permanent method, for example, by welding. The second method for attaching the conduit 14 is shown in FIG. 6. The section 220 of the inner surface 208 adjacent to the conduit end 204 is threaded, where the thread is sized to accept an external thread at the end of the conduit 62. The third method for attaching the conduit 14 is shown in FIG. 7. The section 226 of the outer surface 224 adjacent to the conduit end 222 is threaded, where the thread is sized to accept an internal thread at the end of the conduit 62.

Figure 8:
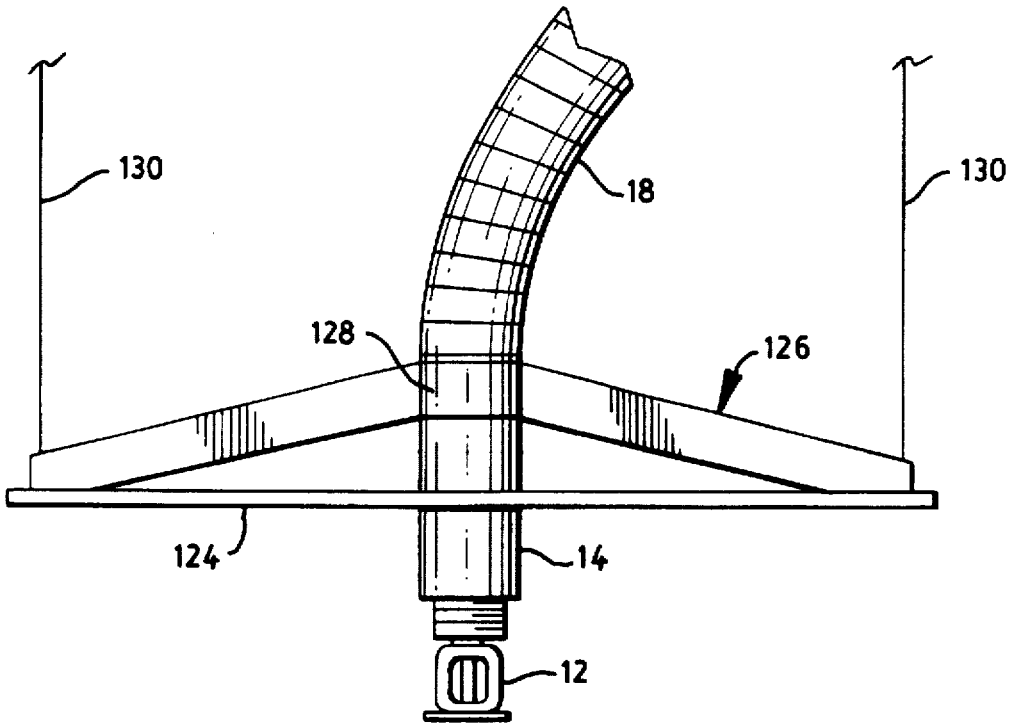
FIG. 8 is a side view of one method of mounting the fitting.

The third variable parameter of the fitting 14 is the method by which the fitting is mounted to the ceiling, of which there are three contemplated methods. The first is shown in FIG. 8. It is the preferred method for mounting the present invention to a suspended ceiling tile 124, as in the sprinkler system of FIG. 2, and uses a frame 126 having a central hub 128 into which the fitting 14 is mounted. The frame 126 is held in place by the wires 130 that suspend the ceiling tile 124.

Figure 9:
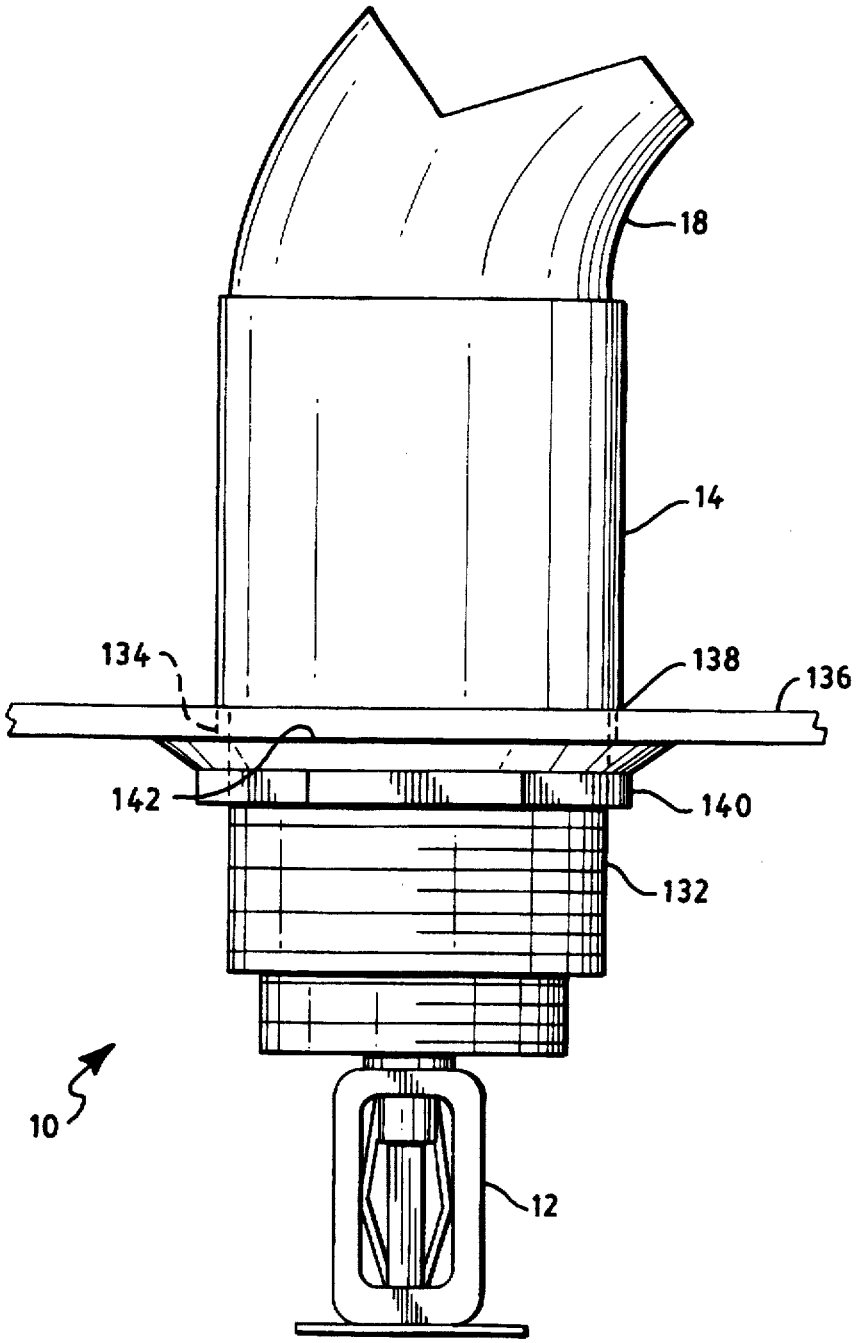
FIG. 9 is a side view of a second method of mounting the fitting.

For the second mounting method, shown in FIGS. 6 and 9, the outer surface 206 has a threaded intermediate section 132. The threads are used to mount the fitting 14 into a hole in a ceiling lattice, such as in the clean room sprinkler system of FIG. 3. The combined sprinkler head 12 and fitting 14 is inserted through a hole 134 in the ceiling 136 until the shoulder 138 formed between the intermediate section 132 and the conduit outer section is resting on the ceiling 136. A mounting nut 140 that has an annular face 142 perpendicular to the axis of the nut 140 fits over the sprinkler head 12 and is turned onto the intermediate section 132 until the portion of the ceiling adjacent to the hole 134 is securely clamped between the annular face 142 of the nut 140 and the shoulder 138.

Figure 10:
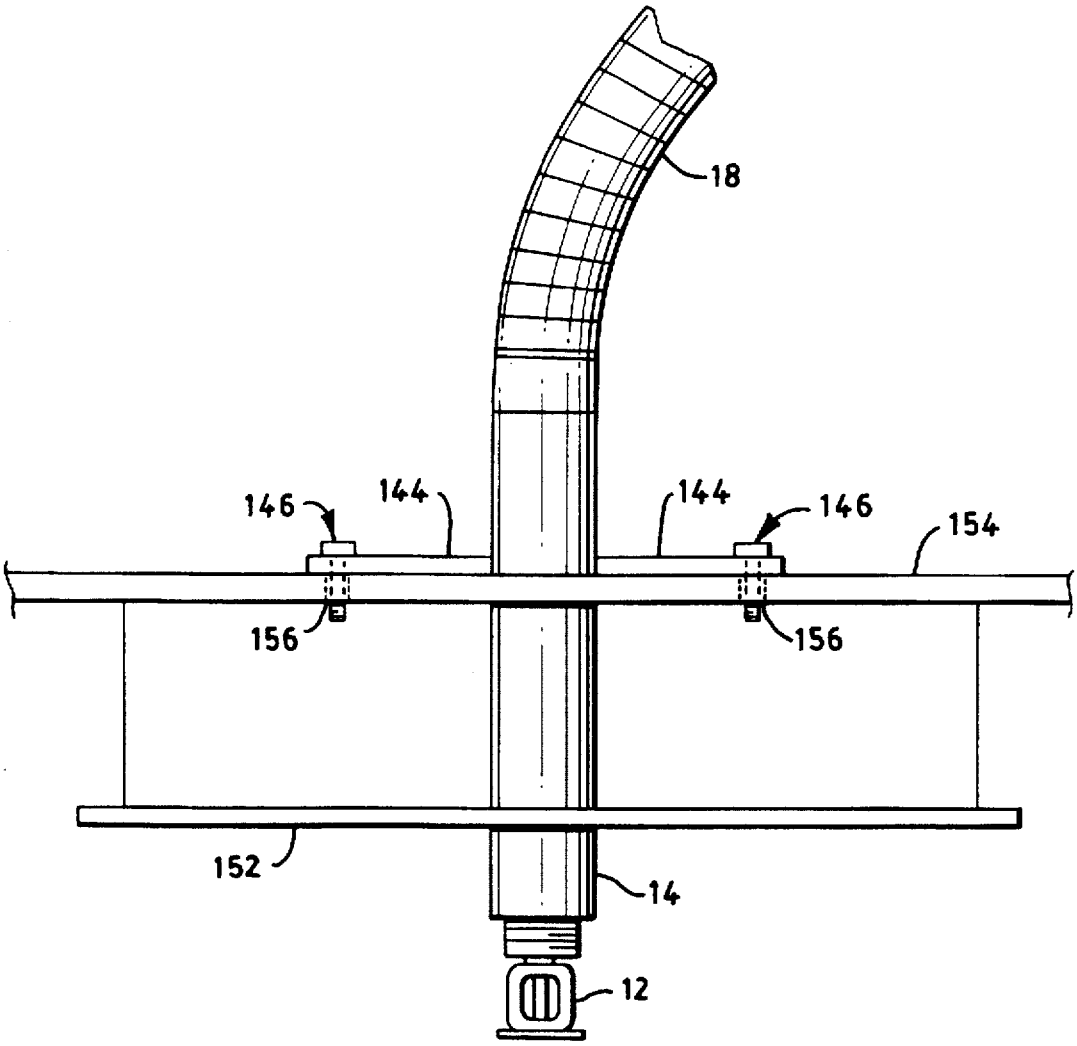
FIG. 10 is a side view of a third method of mounting the fitting.

For the third mounting method, shown in FIGS. 7 and 10, the outer surface 224 has a plurality of arms 144 extending substantially radially from the outer surface 224. There is at least one captured screw 146 near the end of each arm 144. Optionally, the screw head 148 is large enough to be operated by fingers so that a screw driver is not necessary. Optionally, the screw head 148 is biased away from the arm 144 by a coil spring 150. The screws 146 are turned into threaded holes 156 in the frame 154 that supports the ceiling tiles 152.

The Cap of FIGS. 11–14

Figure 11:
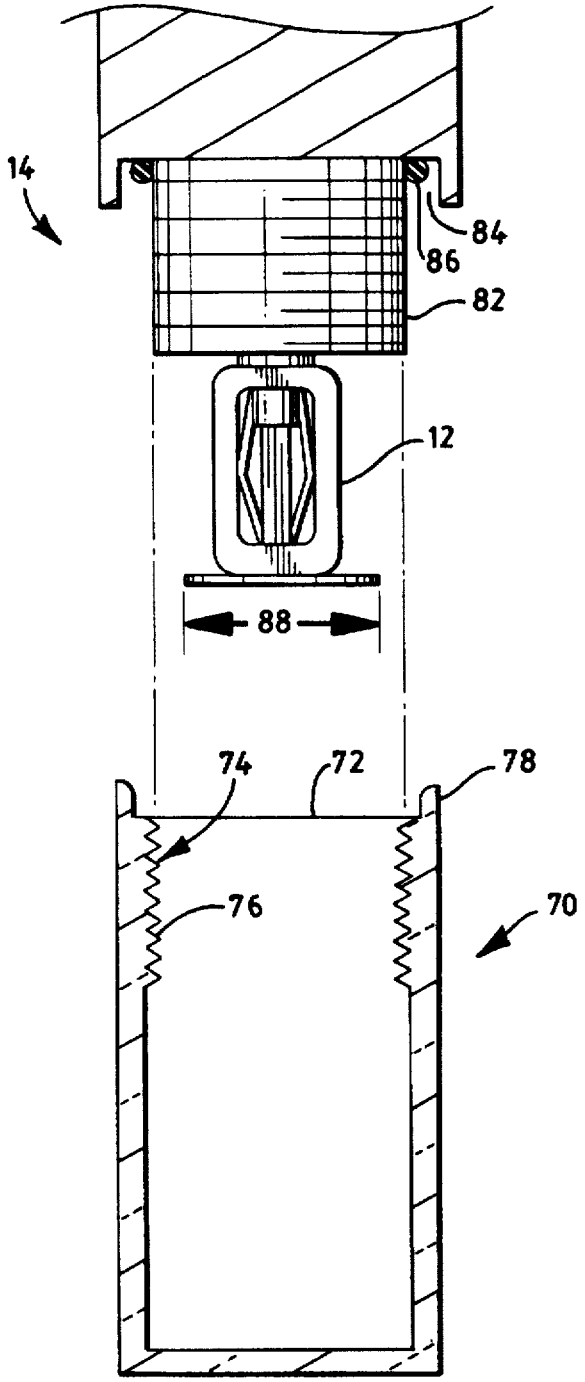
FIG. 11 is a cross-sectional view of one embodiment of the cap.

A cross-sectional view of one embodiment of the cap 70 is shown in FIG. 11. Preferably, the cap 70 is a transparent, rigid polymeric plastic cup that has an inside diameter larger than the overall diameter 88 of the sprinkler head 12 and the same size as the outer diameter of the cap section 82 of the fitting 14. The thickness of the cap 70 is preferably about ⅛ inch.

The inner surface 74 at the mouth 72 of the cap 70 is threaded, where the threads 76 are sized to mate with external threads of the cap section 82 of the fitting 14. The cap threads 76 extend at least ½ inch into the cap 70.

If the sprinkler head 12 activates, the purpose of the cap 70 is to contain the fluid exiting from the head 12. If the cap 70 is subjected to high fluid pressures, for example, greater than 50 pounds per square inch (psi), the pressure can cause the cap 16 to expand, drastically decreasing the ability of the cap to contain the fluid. To substantially alleviate this problem, the cap 70 has a circular lip 78 extending upwardly from edge of the mouth 72. When the cap 70 is installed on the fitting 14, the lip 78 fits into the circular groove 84 of the fitting 14 and the O-ring 86 wedges between the lip 78 and the cap section 82 of the fitting 14, producing a watertight seal. This configuration will withstand a fluid pressure up to approximately 100 psi, more that enough for the vast majority of sprinkler applications.

If the sprinkler head 12 is damaged in some way that causes it to activate, the exiting fluid is contained by the cap 70. Because of the transparent nature of the cap 70, any fluid exiting the sprinkler head 12 is visible before the cap 70 is removed.

Figure 12:
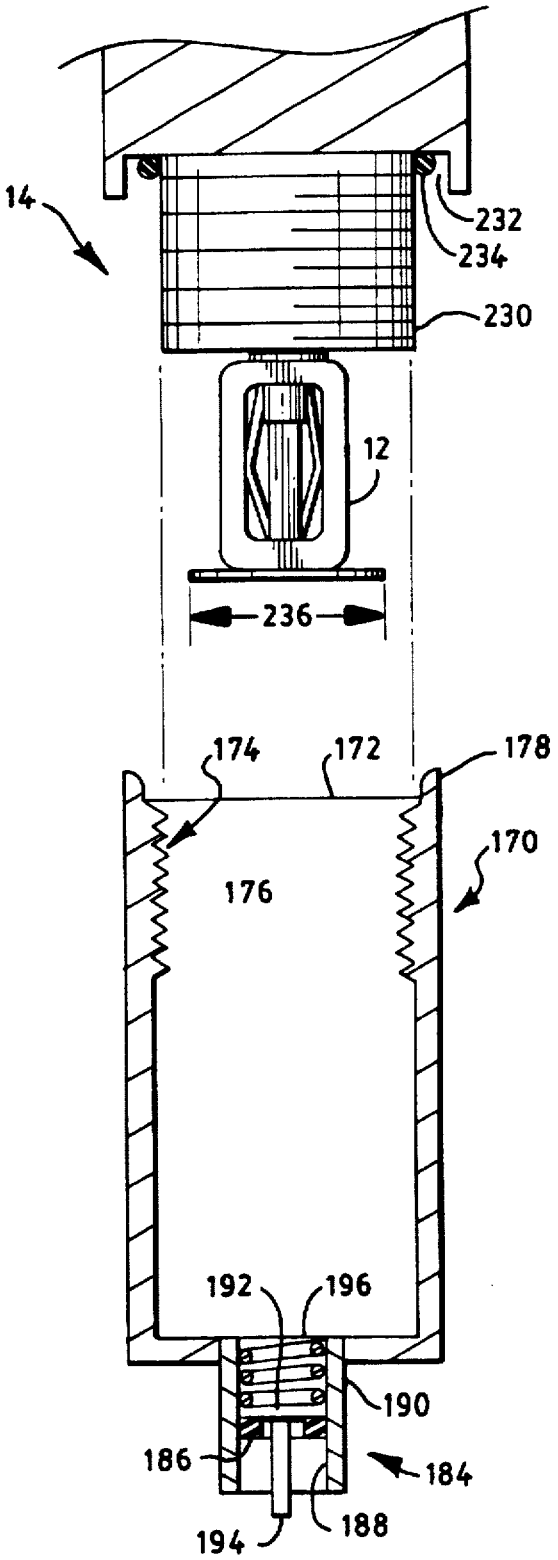
FIG. 12 is a cross-sectional view of a second embodiment of the cap.

A cross-sectional view of a second embodiment of the cap 170 is shown in FIG. 12. Preferably, the cap 170 is a rigid cup that has an inside diameter larger than the overall diameter 236 of the sprinkler head 12 and the same size as the outer diameter of the cap section 230 of the fitting 14. The thickness of the cap 170 is preferably about ⅛ inch.

The inner surface 174 at the mouth 172 of the cap is threaded, where the threads 176 are sized to mate with external threads of the cap section 230 of the fitting 14. The cap threads 176 extend at least ½ inch into the cap 170.

For the reasons described above in reference to the first cap embodiment 70, the cap 170 has a circular lip 178 extending upwardly from edge of the mouth 172. When the cap 170 is installed on the fitting 14, the lip 178 fits into the circular groove 232 of the fitting 14 and the O-ring 234 wedges between the lip 178 and the cap section 230 of the fitting 14, producing a watertight seal.

Extending from the bottom of the cap 170 is a valve 184. The valve 184 is a hollow tube 190 that has a shoulder 186 extending radially from the entire circumference of the interior surface 188 of the tube 190. A circular hatch 192 seats against the upper edge of the shoulder 186 by the force of a spring 196, forming a watertight seal. A pin 194 extends from the bottom side of the hatch beyond the lower edge of the tube 190. When the pin 194 is pushed into the tube 190, against the force of the spring 196, the seal between the shoulder 186 and hatch 192 is opened.

If the sprinkler head 12 is damaged in some way that causes it to activate, the exiting fluid is contained by the cap 170. Prior to removing the cap 170, the valve pin 194 is pushed in to determine if there is any fluid in the cap 170.

Figure 13:
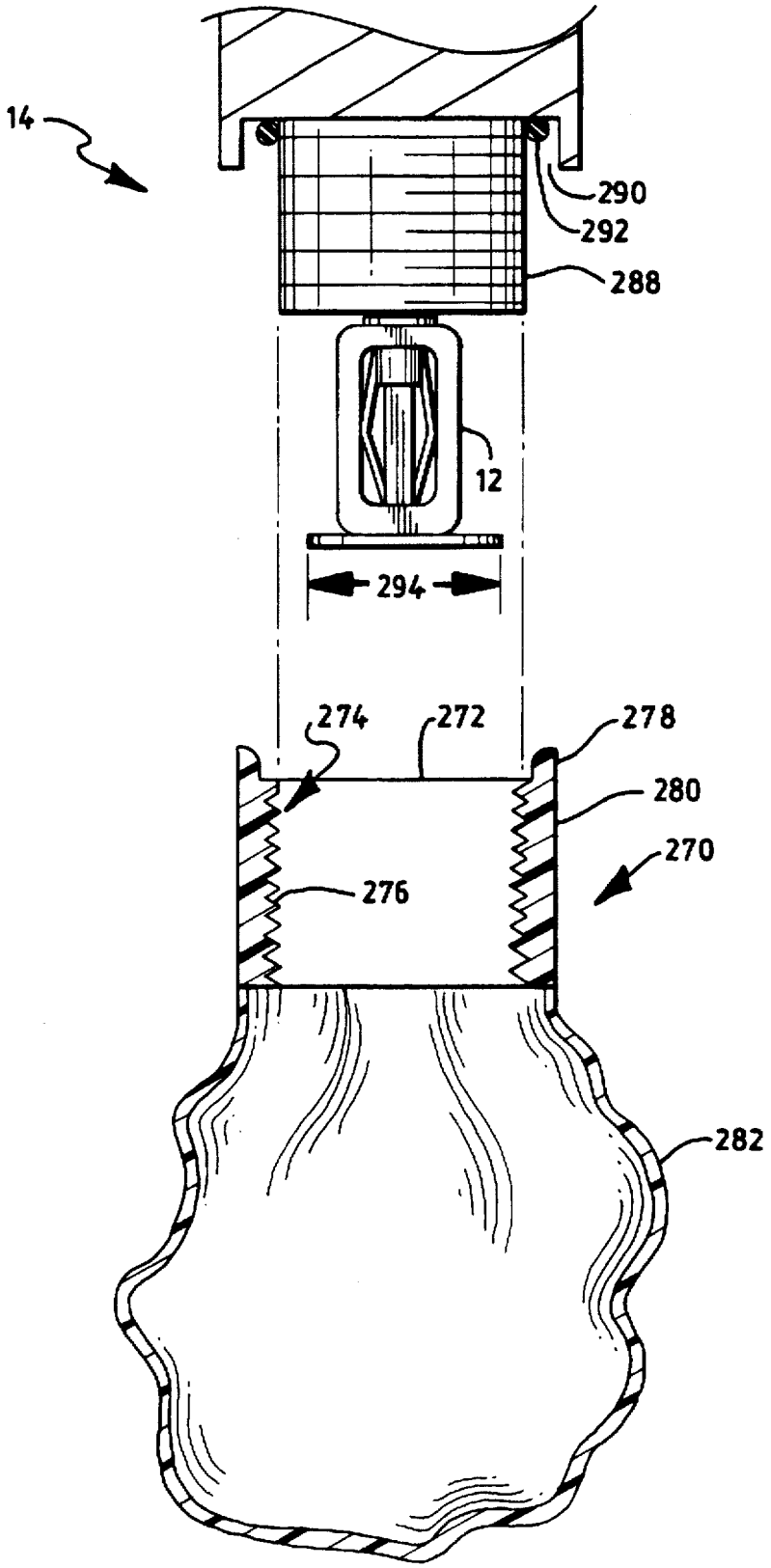
FIG. 13 is a cross-sectional view of a third embodiment of the cap.

A cross-sectional view of a third embodiment of the cap 270 is shown in FIG. 13. The cap 270 includes a rigid collar 280 and flexible bag 282. Preferably, the collar 280 is a composed of a rigid polymeric plastic that has an inside diameter larger than the overall diameter 294 of the sprinkler head 12 and the same diameter as that of the cap section 288 of the fitting 14. The collar 280 has a length of about 1 inch. The inner surface 274 of the collar 280 is threaded, where the threads are sized to mate with external threads of the cap section 288 of the fitting 14. The threads 276 extend at least ½ inch into the collar 280.

For the reasons described above in reference to the first cap embodiment 70, the collar 280 has a circular lip 278 extending upwardly from edge of the mouth 272. When the cap 270 is installed on the fitting 14, the lip 278 fits into the circular groove 290 of the fitting 14 and the O-ring 292 wedges between the lip 278 and the cap section 288 of the fitting 14, producing a watertight seal.

The bag 282 is composed of a thin polymer sheet that can withstand the pressure of fluid coming from the sprinkler head 12. The bag 282 is attached to the collar 280 to form a watertight seal.

If the sprinkler head 12 is inactive, the bag 282 will appear and feel flaccid. If the sprinkler head 12 is damaged in some way that causes it to activate, the exiting fluid is contained by the cap 270. Because of the nature of the cap 270, the flexible bag 282 appears, both visually and tactilely, to be rigid if fluid exits the sprinkler head 12 with system pressure behind it.

Figure 14:
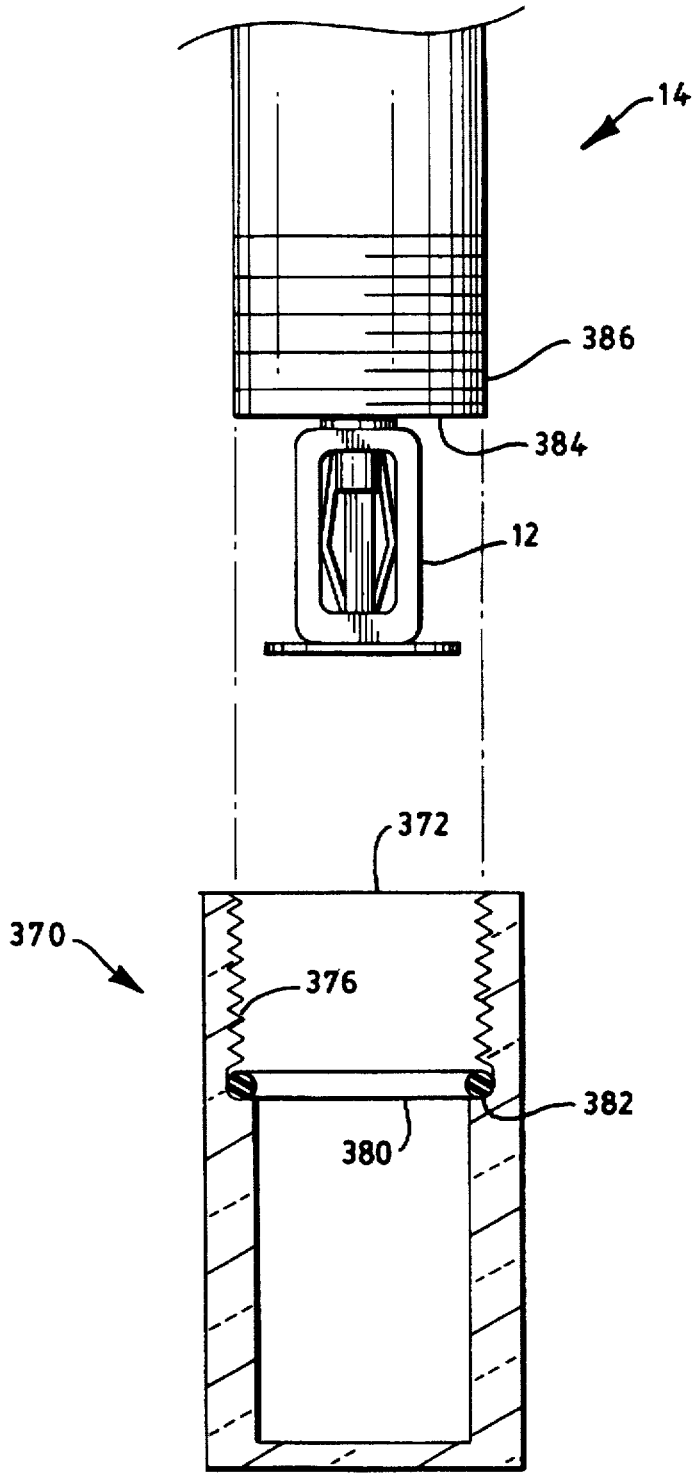
FIG. 14 is a cross-sectional view of an alternate method for connecting the cap to the fitting.

FIG. 14 shows an alternate method for creating a watertight seal between the fitting 14 and the cap 16. Although FIG. 14 shows the method for use with the first cap embodiment, it may be used on any of the above-described cap embodiments. This alternate method is not as preferred as the method described above because the maximum fluid pressure that it can maintain is not as high, but can be used when the potential fluid pressure is relatively low.

In this alternate method, the threads 376 extend into the cap 370 (or collar of the bag embodiment 270) to a shoulder 382. A resilient O-ring 380 is located on the shoulder 382. When the cap 370 is screwed onto the cap section 386 of the fitting 14, the O-ring 380 makes contact with the lower edge 384 of the fitting 14, thereby making a watertight seal between the fitting 14 and the cap 380.

OPERATION

The cap 16 is normally used when it is desired to relocate the sprinkler assemblage 10 while the sprinkler system remains pressurized and operational. However, it can also be used when the sprinkler system is inoperative in order to protect the sprinkler head 12 from damage while being relocated.

To use the present invention 10, screw the cap 16 onto the cap section 110 of the fitting 14 until the seal between the fitting 14 and the cap 16 is watertight and the sprinkler head 12 is enclosed. Relocate the sprinkler assemblage 10. If the cap 16 is of the first cap embodiment, that is, rigid and transparent, remove the cap 16 only if a visual inspection of the sprinkler head 12 through the cap 16 shows that the sprinkler head 12 has suffered no damage. If the cap 16 is of the second cap embodiment, that is, rigid with a valve, remove the cap 16 only if no fluid comes out of the valve when the pin is pushed into the valve tube. If the cap 16 is of the third cap embodiment, that is, a flexible bag, remove the cap 16 only if the bag is not rigid from fluid pressure.

Thus it has been shown and described a sprinkler assemblage which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. In a sprinkler system having hydraulic distribution, a grid of flexible conduits operatively feeding therefrom, a plurality of sprinkler assemblages having operative connections thereto, and a structure having a lattice and a plurality of tiles, said structure enabling transportation of said sprinkler assemblages about said system while maintaining said operative connections, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having a conduit end outer surface adjacent to said conduit end and a head end outer surface adjacent to said head end;

(c) said fitting having an inner surface concentric about said longitudinal axis, said inner surface including a fitting inner threaded surface extending from said head end and an inner conduit surface extending from said fitting inner threaded surface to said conduit end;

(d) a sprinkler head having an externally threaded cylindrical pipe that is turned into said fitting inner threaded surface;

(e) said sprinkler head having a thermally sensitive plug blocking fluid from exiting said pipe at normal room temperatures and melting to unblock said pipe at predetermined elevated temperatures;

(f) said sprinkler head having two operative conditions, an inactive condition when said plug is blocking said fluid and an active condition when said sprinkler head is not blocking said fluid;

(g) a cap adapted to removably attach to said fitting, forming a substantially watertight attachment and enclosing said sprinkler head in a watertight compartment when said cap is attached to said fitting;

(h) said cap including a means for indicating which one of said two operative conditions exists at a given time; and (i) a means for mounting said one assemblage to said structure.

2. The system of claim 1 wherein said fitting is composed of a material selected from the group consisting of steel and stainless steel.

3. The system of claim 1 wherein said head end outer surface is threaded, and said cap has a cap inner threaded surface at a mouth thereof, said cap inner threaded surface being adapted to be turned onto said head end threaded outer surface.

4. The system of claim 3 wherein said watertight attachment includes an O-ring within said cap, said O-ring making contact with said head end of said fitting when said cap is turned onto said head end threaded outer surface.

5. The system of claim 1 wherein said indicating means includes said cap being composed substantially of a rigid transparent polymer to indicate visually which one of said two operative conditions exists at a given time.

6. The system of claim 1 wherein said indicating means includes said cap being composed substantially of a rigid material and wherein said cap further includes a valve adapted to allow movement of pressurized fluid from inside of said cap to outside of said cap when manually operated.

7. The system of claim 1 wherein said indicating means includes a flexible bag that is visibly rigid when said sprinkler head is in said active condition and visibly flaccid when said sprinkler head is in said inactive condition.

8. The system of claim 1, said structure including at least one through mounting hole, wherein said means for mounting said one assemblage to said structure includes:

(a) an intermediate threaded outer surface between said conduit end outer surface and said head end outer surface, said intermediate surface extending through said mounting hole;

(b) a diameter of said intermediate threaded outer surface being smaller than a diameter of said conduit end outer surface, forming a shoulder;

(c) a diameter of said head end outer surface being smaller than said diameter of said intermediate threaded outer surface; and (d) an open mounting nut that is turned onto said intermediate threaded outer surface and having an annular face that is adapted to clamp said structure between said annular face and said shoulder.

9. The system of claim 1 wherein said means for mounting said one assemblage to said structure includes a frame with a central hub and legs extending therefrom, said fitting being mounted in said hub.

10. The system of claim 1 wherein said means for mounting said one assemblage to said structure includes a plurality of arms extending from said conduit end outer surface.

11. In a sprinkler system having hydraulic distribution, a grid of flexible conduits operatively feeding therefrom, a plurality of sprinkler assemblages having operative connections thereto, and a structure having a lattice and a plurality of tiles, said structure enabling transportation of said sprinkler assemblages about said system while maintaining said operative connections, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having a conduit end outer surface adjacent to said conduit end and a head end threaded outer surface adjacent to said head end;

(c) said fitting having an inner surface concentric about said longitudinal axis, said inner surface including a fitting inner threaded surface extending from said head end and an inner conduit surface extending from said fitting inner threaded surface to said conduit end;

(d) a sprinkler head having an externally threaded cylindrical pipe that is turned into said fitting inner threaded surface;

(e) said sprinkler head having a thermally sensitive plug blocking fluid from exiting said pipe at normal room temperatures and melting to unblock said pipe at predetermined elevated temperatures;

(f) said sprinkler head having two operative conditions, an inactive condition when said plug is blocking said fluid and an active condition when said sprinkler head is not blocking said fluid;

(g) a cap having a cap interior threaded surface at a mouth thereof, said cap interior threaded surface being adapted to be turned onto said head end threaded outer surface, forming a substantially watertight attachment;

(h) said watertight attachment including said head end having a circular groove with an axis coincident with said longitudinal axis and an inner surface proximate to said groove axis, said circular groove inner surface having an annular groove, a resilient O-ring located in said annular groove, and a lip extending longitudinally from said cap mouth, said lip fitting into said circular groove and said O-ring being wedged between said circular groove inner surface and said lip when said cap is turned onto said head end threaded outer surface;

(i) said cap including a means for indicating which one of said two operative conditions exists at a given time; and (j) a means for mounting said one assemblage to said structure.

12. The system of claim 11 wherein said fitting is composed of a material selected from the group consisting of steel and stainless steel.

13. The system of claim 11 wherein said indicating means includes said cap being composed substantially of a rigid transparent polymer to indicate visually which one of said two operative conditions exists at a given time.

14. The system of claim 11 wherein said indicating means includes said cap being composed substantially of a rigid material and wherein said cap further includes a valve adapted to allow movement of pressurized fluid from inside of said cap to outside of said cap when manually operated.

15. The system of claim 11 wherein said indicating means includes a flexible bag that is visibly rigid when said sprinkler head is in said active condition and visibly flaccid when said sprinkler head is in said inactive condition.

16. The system of claim 11, said structure including at least one through mounting hole, wherein said means for mounting said one assemblage to said structure includes:

(a) an intermediate threaded outer surface between said conduit end outer surface and said head end outer surface, said intermediate surface extending through said mounting hole;

(b) a diameter of said intermediate threaded outer surface being smaller than a diameter of said conduit end outer surface, forming a shoulder;

(c) a diameter of said head end outer surface being smaller than said diameter of said intermediate threaded outer surface; and (d) an open mounting nut that is turned onto said intermediate threaded outer surface and having an annular face that is adapted to clamp said structure between said annular face and said shoulder.

17. The system of claim 11 wherein said means for mounting said one assemblage to said structure includes a frame With a central hub and legs extending therefrom, said fitting being mounted in said hub.

18. The system of claim 11 wherein said means for mounting said one assemblage to said structure includes a plurality of arms extending from said conduit end outer surface.

* * * * *